US008929788B2

(12) United States Patent
Saitoh

(10) Patent No.: US 8,929,788 B2
(45) Date of Patent: Jan. 6, 2015

(54) FIXING DEVICE HAVING A FIXING PAD AND A PRESSING PAD AND IMAGE FORMING APPARATUS INCORPORATING THE SAME

(75) Inventor: Seiji Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 177 days.

(21) Appl. No.: 13/396,963

(22) Filed: Feb. 15, 2012

(65) Prior Publication Data

US 2012/0224896 A1 Sep. 6, 2012

(30) Foreign Application Priority Data

Mar. 2, 2011 (JP) ..... 2011-044843
Mar. 2, 2011 (JP) ..... 2011-044852

(51) Int. Cl.
*G03G 15/20* (2006.01)
*G03G 15/00* (2006.01)

(52) U.S. Cl.
CPC ..... *G03G 15/2078* (2013.01); *G03G 15/5004* (2013.01); *G03G 2215/2038* (2013.01)
USPC ..... 399/329

(58) Field of Classification Search
USPC ..... 399/329
See application file for complete search history.

(56) References Cited

U.S. PATENT DOCUMENTS 5,722,012 A 2/1998 Saitoh
6,104,889 A 8/2000 Saitoh
6,816,701 B2 11/2004 Saitoh
7,493,059 B2 2/2009 Saitoh
7,761,044 B2 * 7/2010 Yagi et al. ..... 399/329
2003/0007817 A1 1/2003 Saitoh
2006/0127142 A1 * 6/2006 Nakamoto et al. ..... 399/329
2006/0239707 A1 10/2006 Saitoh
2006/0285892 A1 * 12/2006 Nakamoto et al. ..... 399/329
2007/0140760 A1 6/2007 Nakamoto et al.

(Continued)

FOREIGN PATENT DOCUMENTS

CN 1885208 12/2006
JP 04044075 A 2/1992

(Continued)

OTHER PUBLICATIONS

Abstract of JP 04-044075 published Feb. 13, 1992.

(Continued)

*Primary Examiner* — G. M. Hyder
(74) *Attorney, Agent, or Firm* — Harness, Dickey & Pierce P.L.C.

(57) ABSTRACT

A fixing device includes a fixing belt rotatable in a predetermined direction of rotation; a pressing belt to frictionally contact the fixing belt and rotatable in a direction counter to the direction of rotation of the fixing belt; a stationary fixing pad disposed inside a loop formed by the fixing belt; a stationary pressing pad disposed inside a loop formed by the pressing belt; and a fixing belt heater disposed inside the loop formed by the fixing belt to heat the fixing belt. The fixing pad presses against the pressing pad to form a fixing nip therebetween with the fixing belt and the pressing belt interposed between the fixing pad and the pressing pad. A recording medium bearing an unfixed toner image is conveyed through the fixing nip in a state in which the unfixed toner image contacts the fixing belt.

15 Claims, 6 Drawing Sheets

(56) References Cited

U.S. PATENT DOCUMENTS

| | | | | |
|---|---|---|---|---|
| 2008/0031664 | A1* | 2/2008 | Yagi et al. | 399/333 |
| 2010/0310287 | A1* | 12/2010 | Mikutsu | 399/322 |
| 2011/0064440 | A1 | 3/2011 | Saitoh | |

FOREIGN PATENT DOCUMENTS

| | | | | |
|---|---|---|---|---|
| JP | 07287461 | A | | 10/1995 |
| JP | 08262903 | A | | 10/1996 |
| JP | 10213984 | A | | 8/1998 |
| JP | 11002982 | A | | 1/1999 |
| JP | 2006343655 | A | * | 12/2006 |
| JP | 2007057784 | A | * | 3/2007 |
| JP | 2009069226 | A | * | 4/2009 |
| JP | 2009086391 | A | * | 4/2009 |
| JP | 2009237120 | A | * | 10/2009 |
| JP | 2009237350 | A | | 10/2009 |
| JP | 2010217457 | A | * | 9/2010 |

OTHER PUBLICATIONS

Abstract of JP 08-262903 published Oct. 11, 1996.
Abstract of JP 2009-237350 published Oct. 15, 2009.
Abstract of JP 07-287461 published Oct. 31, 1995.
Abstract of JP 10-213984 published Aug. 11, 1998.
Abstract of JP 11-002982 published Jan. 6, 1999.
Office Action for corresponding Chinese patent application No. 201210043858.7 dated Mar. 18, 2014.

* cited by examiner

FIXING DEVICE HAVING A FIXING PAD AND A PRESSING PAD AND IMAGE FORMING APPARATUS INCORPORATING THE SAME

CROSS-REFERENCE TO RELATED APPLICATIONS

This patent application is based on and claims priority pursuant to 35 U.S.C. §119 to Japanese Patent Application Nos. 2011-044843, filed on Mar. 2, 2011, and 2011-044852, filed on Mar. 2, 2011, in the Japanese Patent Office, the entire disclosure of which is hereby incorporated herein by reference.

FIELD OF THE INVENTION

Example embodiments generally relate to a fixing device and an image forming apparatus, and more particularly, to a fixing device for fixing a toner image on a recording medium and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image forming processes below. Thus, for example, a charger uniformly charges a surface of an image carrier; an optical writer emits a light beam onto the charged surface of the image carrier to form an electrostatic latent image on the image carrier according to image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a fixing rotary body heated by a heater and a pressing rotary body pressed against the fixing rotary body to form a fixing nip therebetween. As a recording medium bearing an unfixed toner image is conveyed through the fixing nip, the fixing rotary body heated by the heater contacts an image side of the recording medium that bears the unfixed toner image and the pressing rotary body contacts a non-image side of the recording medium that does not bear the unfixed toner image. That is, the fixing rotary body heats the unfixed toner image while the pressing rotary body presses the recording medium against the fixing rotary body, thus melting and fixing the toner image on the recording medium.

Generally, a roller and a flexible endless belt are used as the fixing rotary body and the pressing rotary body with one of four examples of the combination of the roller and the belt described below.

The first example is the combination of a fixing belt as the fixing rotary body and a pressing roller as the pressing rotary body. The fixing belt is stretched over and supported by a fixing roller and a heating roller inside which a heater is disposed. The heater heats the heating roller which in turn heats the fixing belt. The pressing roller is pressed against the fixing roller via the fixing belt to form a fixing nip between the pressing roller and the fixing belt. As a recording medium bearing an unfixed toner image is conveyed through the fixing nip, the fixing belt and the pressing roller apply heat and pressure to the recording medium, thus fixing the toner image on the recording medium.

The second example is the combination of a fixing belt as the fixing rotary body and a pressing roller as the pressing rotary body. Unlike the first example described above, the fixing belt of the second example is a belt-shaped film with no roller disposed inside it. Specifically, the pressing roller is pressed against a heater disposed inside the belt-shaped film via the belt-shaped film to form a fixing nip between the pressing roller and the belt-shaped film. As a recording medium bearing an unfixed toner image is conveyed through the fixing nip, the belt-shaped film heated by the heater and the pressing roller apply heat and pressure to the recording medium, thus fixing the toner image on the recording medium.

The third example is the combination of a fixing roller as the fixing rotary body and a pressing belt as the pressing rotary body. As contrasted to the first example described above, the pressing belt, instead of the fixing belt, is stretched over and supported by a plurality of rollers disposed inside a loop formed by the pressing belt. Specifically, a stationary pressing pad disposed inside the loop formed by the pressing belt is pressed against the fixing roller via the pressing belt to form a fixing nip between the pressing belt and the fixing roller. As a recording medium bearing an unfixed toner image is conveyed through the fixing nip, the fixing roller heated by a heater disposed inside it and the pressing belt apply heat and pressure to the recording medium, thus fixing the toner image on the recording medium.

The fourth example is the combination of a fixing roller as the fixing rotary body and a pressing belt as the pressing rotary body. Unlike the pressing belt of the third example described above, the pressing belt of the fourth example is supported by a tubular guide disposed inside a loop formed by the pressing belt, not by the plurality of rollers. Like the third example, the stationary pressing pad disposed inside the loop formed by the pressing belt is pressed against the fixing roller via the pressing belt to form a fixing nip between the pressing belt and the fixing roller. As a recording medium bearing an unfixed toner image is conveyed through the fixing nip, the fixing roller heated by a heater disposed inside it and the pressing belt apply heat and pressure to the recording medium, thus fixing the toner image on the recording medium.

However, the first to fourth examples described above have a drawback of increasing the heat capacity of the fixing rotary body and the pressing rotary body. Specifically, the fixing belt of the first example stretched over the plurality of rollers has an increased loop diameter that increases the heat capacity of the fixing belt. The pressing roller of the second example pressed against the heater disposed inside the belt-shaped film has a thick rubber layer that increases the heat capacity of the pressing roller. The fixing roller of the third example pressing against the pressing pad to form the fixing nip is constructed of a plurality of layers including a thick rubber layer that increases the heat capacity of the fixing roller. Additionally, the pressing belt of the third example stretched over the plurality of rollers has an increased loop diameter that increases the heat capacity of the pressing belt. The fixing roller of the fourth example pressing against the pressing pad to form the fixing nip is constructed of a plurality of layers including a thick elastic layer that increases the heat capacity of the fixing roller.

As a result, the increased heat capacity of the fixing rotary body and the pressing rotary body may increase power consumption and lengthen a warm-up time required to warm up the fixing device and a first print time required to complete the image forming processes described above.

SUMMARY OF THE INVENTION

At least one embodiment may provide a fixing device that includes a fixing belt formed into a loop and rotatable in a predetermined direction of rotation: a pressing belt formed into a loop to frictionally contact the fixing belt and rotatable in a direction counter to the direction of rotation of the fixing belt; a stationary fixing pad disposed inside the loop formed by the fixing belt: a stationary pressing pad disposed inside the loop formed by the pressing belt; and a fixing belt heater disposed inside the loop formed by the fixing belt to heat the fixing belt. The fixing pad presses against the pressing pad to form a fixing nip therebetween with the fixing belt and the pressing belt interposed between the fixing pad and the pressing pad. A recording medium bearing an unfixed toner image is conveyed through the fixing nip in a state in which the unfixed toner image contacts the fixing belt.

At least one embodiment may provide an image forming apparatus that includes the fixing device described above.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
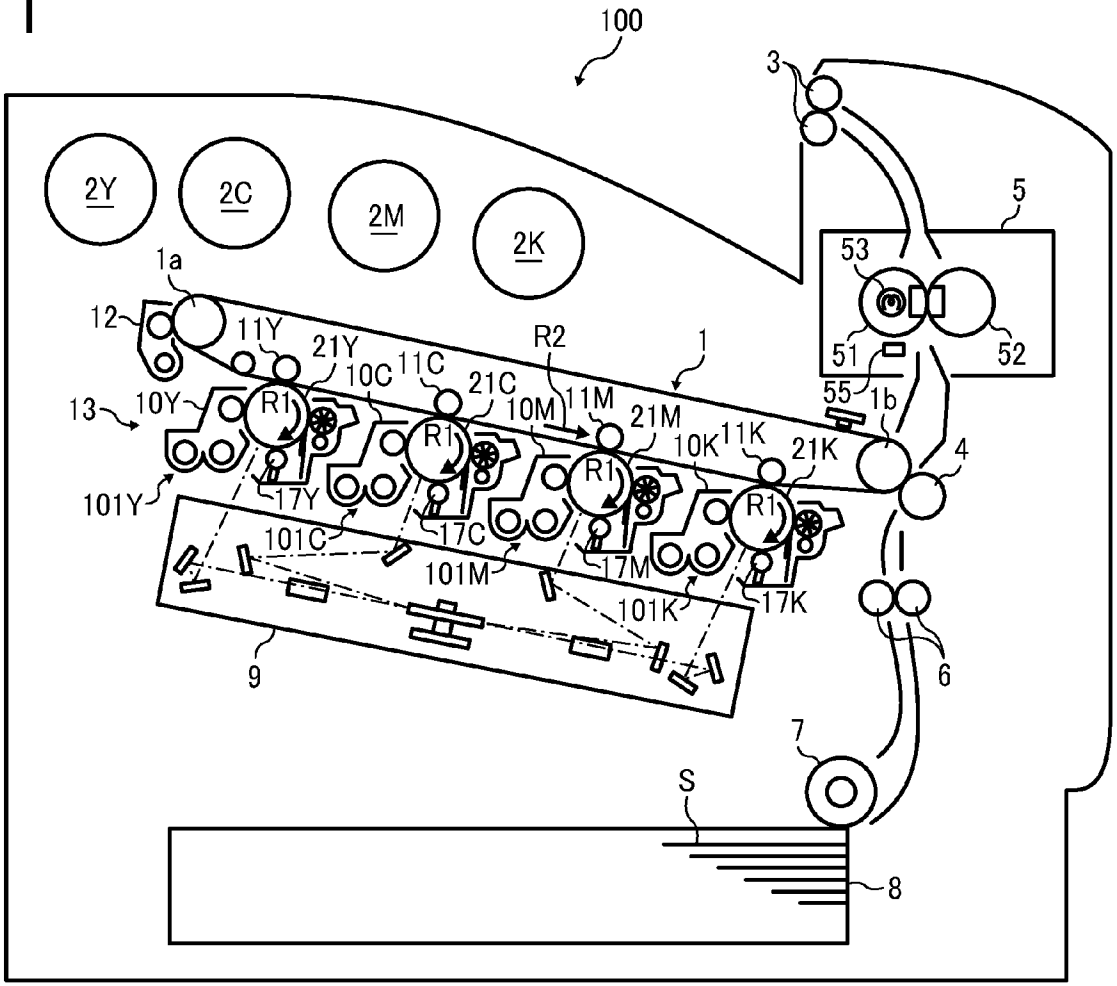
FIG. 1 is a schematic sectional view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended. to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

FIG. 1 is a schematic sectional view of the image forming apparatus 100. As illustrated in FIG. 1, the image forming apparatus 100 may be a copier, a facsimile machine, a printer, a multifunction printer having at least one of copying, printing, scanning, plotter, and facsimile functions, or the like. According to this example embodiment, the image forming apparatus 100 is a tandem color printer for forming a color image on a recording medium by electrophotography.

Referring to FIG. 1, the following describes the structure of the image forming apparatus 100.

As illustrated in FIG. 1, the image forming apparatus 100 includes a tandem image forming unit 13 constructed of four image forming devices 101Y, 101C, 101M, and 101K disposed in a center portion of the image forming apparatus 100 and aligned in a horizontal direction. For example, the image forming device 101Y that forms a yellow toner image, the image forming device 101C that forms a cyan toner image, the image forming device 101M that forms a magenta toner image, and the image forming device 101K that forms a black toner image are arranged in this order from the left to the right of the drawing. The image forming devices 101Y, 101C, 101M, and 101K include drum-shaped photoconductors 21Y, 21C, 21M, and 21K surrounded by chargers 17Y, 17C, 17M, and 17K, development devices 10Y, 10C, 10M, and 10K, and cleaners, respectively. Yellow, cyan, magenta, and black toner bottles 2Y, 2C, 2M, and 2K disposed in an upper portion of the image forming apparatus 100 supply yellow, cyan, magenta, and black toners in a predetermined amount to the development devices 10Y, 10C, 10M, and 10K through toner supply tubes, respectively.

Below the tandem image forming unit 13 is an optical writing unit 9 that forms an electrostatic latent image on the respective photoconductors 21Y, 21C, 21M, and 21K. The optical writing unit 9 includes a light source, a polygon mirror, an f theta lens, and reflection mirrors to emit laser beams onto an outer circumferential surface of the respective photoconductors 21Y, 21C, 21M, and 21K. Specifically, the laser beams scan the outer circumferential surface of the respective photoconductors 21Y, 21C, 21M, and 21K according to image data sent from an external device, such as a client computer. Above the tandem image forming unit 13 is an endless intermediate transfer belt 1 looped over a plurality of support rollers 1*a* and 1*b*. A driver (e.g., a motor) is connected to a rotation shaft of the support roller 1*a*. As the driver drives and rotates the support roller 1*a*, the support roller 1*a* rotates the intermediate transfer belt 1 counterclockwise in a rotation direction R2. Simultaneously, the rotating intermediate transfer belt 1 rotates the support roller 1*b*. Primary transfer rollers 11Y, 11C, 11M, and 11K disposed inside a loop formed by the intermediate transfer belt 1 transfer the yellow, cyan, magenta, and black toner images formed on the photoconductors 21Y, 21C, 21M, and 21K onto an outer circumferential surface of the intermediate transfer belt 1 in such a manner that the yellow, cyan, magenta, and black toner images are superimposed on the same position on the intermediate transfer belt 1, thus forming a color toner image on the intermediate transfer belt 1.

Downstream from the primary transfer roller 11K in the rotation direction R2 of the intermediate transfer belt 1 is a secondary transfer roller 4. The support roller 1*b* is disposed opposite the secondary transfer roller 4 via the intermediate transfer belt 1 in such a manner that the support roller 1*b* presses against the secondary transfer roller 4 via the intermediate transfer belt 1. A paper tray 8 disposed in a bottom portion of the image forming apparatus 100 loads a plurality of recording media S (e.g., sheets). Above the paper tray 8 is a feed roller 7 that picks up and feeds an uppermost recording medium S from the paper tray 8 to a registration roller pair 6. The registration roller pair 6 feeds the recording medium S to a secondary transfer nip formed between the secondary transfer roller 4 and the intermediate transfer belt 1 at a time when the secondary transfer roller 4 transfers the color toner image formed on the intermediate transfer belt 1 onto the recording medium S. After the transfer of the color toner image onto the recording medium S, a belt cleaner 12 disposed opposite the intermediate transfer belt 1 removes residual toner not transferred onto the recording medium S and therefore remaining on the intermediate transfer belt 1 therefrom.

Downstream from the secondary transfer roller 4 in a conveyance direction of the recording medium S is a fixing device 5 (e.g., a fuser unit) that fixes the toner image on the recording medium S and an output roller pair 3 that discharges the recording medium S bearing the fixed toner image onto an outside of the image forming apparatus 100.

Referring to FIG. 1, a description is now given of the operation of the image forming apparatus 100 having the above-described structure.

As the photoconductors 21Y, 21C, 21M, and 21K rotate in the rotation direction R1, the chargers 17Y, 17C, 17M, and 17K uniformly charge the outer circumferential surface of the respective photoconductors 21Y, 21C, 21M, and 21K. Then, the optical writing unit 9 emits laser beams onto the charged outer circumferential surface of the respective photoconductors 21Y, 21C, 21M, and 21K according to image data sent from a client computer, for example, thus forming an electrostatic latent image on the respective photoconductors 21Y, 21C, 21M, and 21K. Thereafter, the development devices 10Y, 10C, 10M, and 10K supply yellow, cyan, magenta, and black toners to the electrostatic latent images on the photoconductors 21Y, 21C, 21M, and 21K, thus visualizing the electrostatic latent images as yellow, cyan, magenta, and black toner images, respectively.

As the driver drives and rotates the support roller 1*a* over which the intermediate transfer belt 1 is looped, the support roller 1*a* rotates the intermediate transfer belt 1 in the rotation direction R2 which in turn rotates the support roller 1*b* and the secondary transfer roller 4. As the intermediate transfer belt 1 rotates in the rotation direction R2, the primary transfer rollers 11Y, 11C, 11M, and 11K primarily transfer the yellow, cyan, magenta, and black toner images formed on the photoconductors 11Y, 11C, 11M, and 11K onto the intermediate transfer belt 1 successively in such a manner that the yellow, cyan, magenta, and black toner images are superimposed on the same position on the intermediate transfer belt 1, thus forming a color toner image on the intermediate transfer belt 1.

After the transfer of the yellow, cyan, magenta, and black toner images from the photoconductors 21Y, 21C, 21M, and 21K, cleaners disposed opposite the photoconductors 21Y, 21C, 21M, and 21K remove residual toner not transferred onto the intermediate transfer belt 1 and therefore remaining on the photoconductors 21Y, 21C, 21M, and 21K therefrom, respectively. Thus, the photoconductors 21Y, 21C, 21M, and 21K become ready for the next image forming processes performed thereon.

The feed roller 7 picks up and feeds an uppermost recording medium S from a plurality of recording media S loaded on the paper tray 8 to the registration roller pair 6. When the uppermost recording medium S reaches the registration roller pair 6, it stops the recording medium S temporarily. Then, the registration roller pair 6 resumes rotating to feed the recording medium S to the secondary transfer nip formed between the secondary transfer roller 4 and the intermediate transfer belt 1 at a time when the color toner image formed on the intermediate transfer belt 1 is secondarily transferred onto the recording medium S. As the recording medium S is conveyed through the secondary transfer nip, the secondary transfer roller 4 secondarily transfers the color toner image formed on the intermediate transfer belt 1 onto the recording medium S.

Then, the recording medium S bearing the color toner image is conveyed to the fixing device 5 where a fixing belt 51 heated by a heater 53 and a pressing belt 52 apply heat and pressure to the recording medium S, thus melting and fixing the color toner image on the recording medium S. Thereafter, the recording medium S bearing the fixed color toner image is conveyed to the output roller pair 3 that outputs the recording medium S onto the outside of the image forming apparatus 100. After the transfer of the color toner image from the intermediate transfer belt 1, the belt cleaner 12 removes residual toner not transferred from the intermediate transfer belt 1 and therefore remaining on the intermediate transfer belt 1 therefrom. Thus, the intermediate transfer belt 1 becomes ready for the next image forming processes performed thereon.

Figure 2:
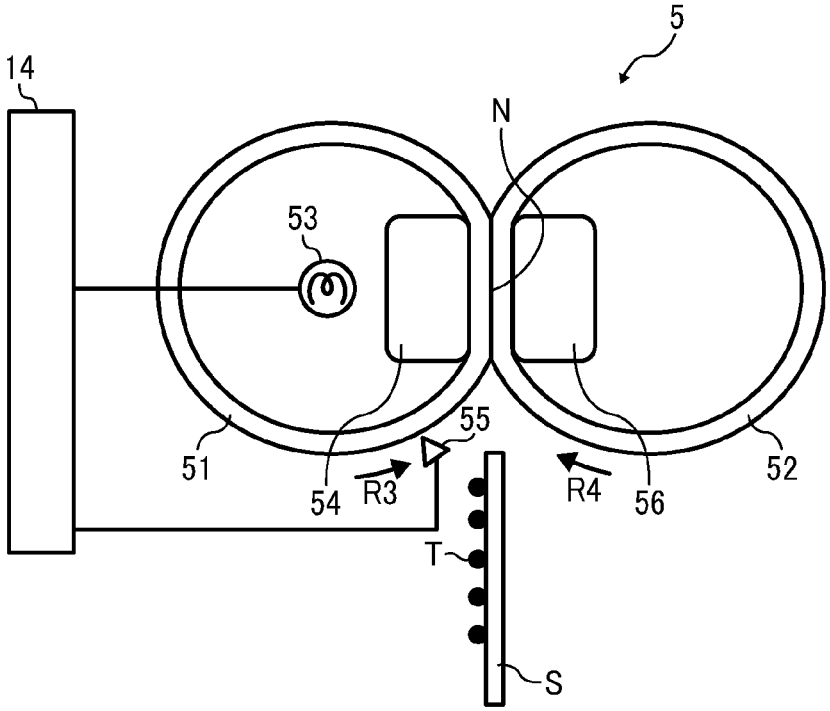
FIG. 2 is a vertical sectional view of a fixing device installed in the image forming apparatus shown in FIG. 1.

Referring to FIG. 2, the following describes the fixing device 5 installed in the image forming apparatus 100 described above.

FIG. 2 is a vertical sectional view of the fixing device 5. As illustrated in FIG. 2, the fixing device 5 includes the fixing belt 51 serving as a fixing rotary body that rotates in a rotation direction R3 and the pressing belt 52 serving as a pressing rotary body that rotates in a rotation direction R4 counter to the rotation direction R3 of the fixing belt 51. The pressing belt 52 is disposed opposite and pressed against the fixing belt 51 to form a fixing nip N therebetween through which a recording medium S bearing an unfixed toner image T is conveyed. As the recording medium S passes through the fixing nip N, the fixing belt 51 contacts an image side of the recording medium S that bears the unfixed toner image T and the pressing belt 52 contacts a non-image side of the recording medium S that bears no unfixed toner image T. Alternatively, during duplex printing for forming a toner image on both sides of a recording medium S, the pressing belt 52 contacts a fixed toner image on the back side of the recording medium S. A temperature detector 55 is disposed opposite an outer circumferential surface of the fixing belt 51 to detect a temperature thereof. A controller 14 is operatively connected to the heater 53 and the temperature detector 55. The controller 14, that is, a central processing unit (CPU) provided with a random-access memory (RAM) and a read-only memory (ROM), for example, controls the heater 53 based on the temperature of the fixing belt 51 detected by the temperature detector 55 so as to adjust the temperature of the outer circumferential surface of the fixing belt 51 to a predetermined fixing temperature.

Inside a loop formed by the fixing belt 51 is a fixing pad 54. Similarly, inside a loop formed by the pressing belt 52 is a pressing pad 56. The fixing pad 54 is disposed opposite the pressing pad 56 in such a manner that the fixing pad 54 presses the fixing belt 51 against the pressing pad 56 via the pressing belt 52 and at the same time the pressing pad 56 presses the pressing belt 52 against the fixing pad 54 via the fixing belt 51. Thus, the fixing nip N is formed between the fixing belt 51 and the pressing belt 52 through which the recording medium S bearing the unfixed toner image T is conveyed.

With this configuration of the fixing device 5, the pressing belt 52 and the pressing pad 56 are employed instead of a pressing roller constructed of a thick elastic layer. That is, the recording medium S is nipped between the fixing belt 51 and the pressing belt 52 that have a heat capacity smaller than that of the pressing roller. Additionally, the fixing belt 51 and the pressing belt 52 have a relatively small loop diameter, decreasing the heat capacity of the entire fixing device 5. As a result, the fixing device 5 attains decreased power consumption, shortened warm-up time and first print time, and downsizing of the fixing device 5. It is to be noted that the warm-up time denotes the time required to heat the fixing belt 51 to a predetermined fixing temperature and the first print time denotes the time required to complete a print job, that is, the time required to warm up the image forming apparatus 100 depicted in FIG. 1 upon receipt of a print job, perform the image forming processes described above, and discharge a recording medium S bearing a fixed toner image onto the outside of the image forming apparatus 100.

A description is now given of the configuration of the fixing belt 51.

The fixing belt 51 serving as a fixing rotary body is a thin, flexible endless belt that rotates counterclockwise in the rotation direction R3. The fixing belt 51 having a thickness not greater than about 1 mm is constructed of a base layer, an elastic layer disposed on the base layer, and a release layer disposed on the elastic layer. The base layer of the fixing belt 51, having a thickness in a range of from about 30 micrometers to about 50 micrometers, is made of a metal material such as nickel and stainless steel and/or a resin material such as polyimide. The elastic layer of the fixing belt 51, having a thickness in a range of from about 100 micrometers to about 300 micrometers, is made of a rubber material such as silicone rubber, silicone rubber foam, and fluorocarbon rubber. The elastic layer eliminates or reduces slight surface asperities of the fixing belt 51 at the fixing nip N formed between the fixing belt 51 and the pressing belt 52. Accordingly, heat is uniformly conducted from the fixing belt 51 to the unfixed toner image T on the recording medium S, minimizing formation of a rough image such as an orange peel image. The release layer of the fixing belt 51, having a thickness in a range of from about 10 micrometers to about 50 micrometers, is made of tetrafluoroethylene perfluaroalkylvinylether copolymer (PEA), polyimide, polyetherimide, polyether sulfide (PES), or the like. The release layer releases or separates the toner image T on the recording medium S from the fixing belt 51.

A description is now given of the configuration of the pressing belt 52.

The pressing belt 52 is made of materials similar to those of the fixing belt 51 described above. However, since the pressing belt 52 faces the back side of the recording medium S that bears no unfixed toner image T, the pressing belt 52 does not have the elastic layer that is usually provided to enhance quality of the toner image T.

A description is now given of the configuration of the fixing pad 54 and the pressing pad 56.

Since the pressing pad 56 has a configuration similar to that of the fixing pad 54, the configuration of the pressing pad 56 is omitted.

The fixing pad 54 is made of a rigid base made of a metal material, an elastic layer disposed on the base as needed, and a surface layer disposed on the elastic layer. Alternatively, the base may be made of other material that improves strength, workability cost performance, and the like. The surface layer of the fixing pad 54 contacts an inner circumferential surface of the fixing belt 51 in such a manner that the fixing belt 51 slides over the surface layer of the fixing pad 54 as the fixing belt 51 rotates in the rotation direction R3. Accordingly, the surface layer of the fixing pad 54 is made of a material having a low friction coefficient, for example, a fluorine material such as PEA and polytetrafluoroethylene (PTFE) so as to decrease wear of the fixing belt 51 and the fixing pad 54 due to friction therebetween. The shape of the fixing nip N is designed arbitrarily by considering the direction in which the recording medium S enters and exits from the fixing nip N, adherence of the recording medium S to the fixing belt 51 and the pressing belt 52 as the recording medium S is conveyed through the fixing nip N, frictional resistance between the fixing pad 54 and the fixing belt 51, between the pressing pad 56 and the pressing belt 52, and between the fixing belt 51 and the pressing belt 52, and the like. Considering overall performance, the fixing nip N may be planar.

Generally, a biasing member (e.g., a spring) attached the fixing pad 54 presses the fixing pad 54 against the pressing pad 56. Similarly, a biasing member (e.g., a spring) attached to the pressing pad 56 presses the pressing pad 56 against the fixing pad 54, thus forming the fixing nip N between the fixing pad 54 and the pressing pad 56 with the fixing belt 51 and the pressing belt 52 interposed therebetween.

According to this example embodiment, frictional resistance between the fixing pad 54 and the fixing belt 51 sliding over the fixing pad 54 is relatively great. Similarly, frictional resistance between the pressing pad 56 and the pressing belt 52 sliding over the pressing pad 56 is relatively great. To address this circumstance, the biasing member attached to the fixing pad 54 may press the fixing pad 54 against the pressing pad 56 with decreased pressure; the biasing member attached to the pressing pad 56 may press the pressing pad 56 against the fixing pad 54 with decreased pressure. Alternatively, an interval between the fixing pad 54 and the pressing pad 56 may be adjustable. Yet alternatively, both the biasing members that exert the decreased pressure and the adjustable interval between the fixing pad 54 and the pressing pad 56 may be employed.

Figure 3:
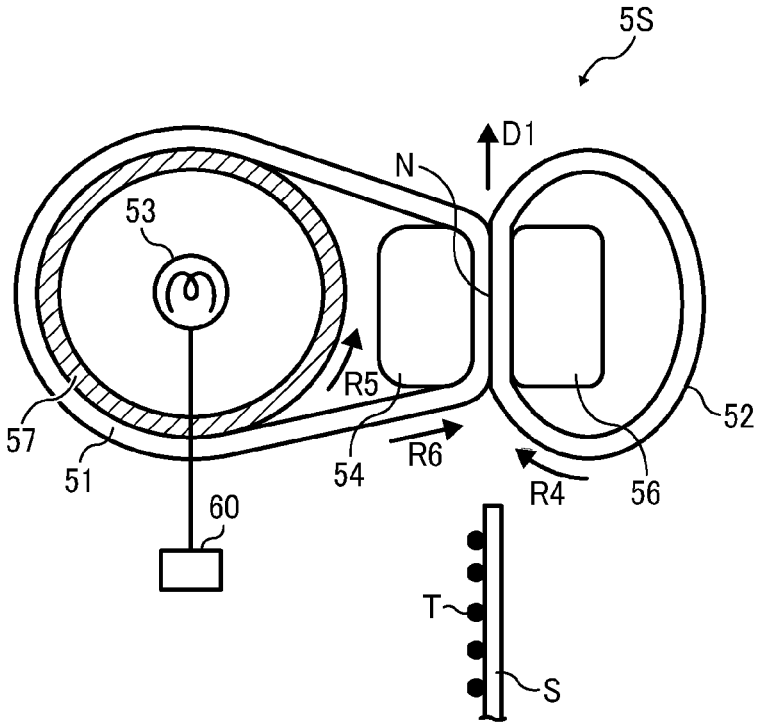
FIG. 3 is a vertical sectional view of a fixing device according to another example embodiment.

Referring to FIG. 3, the following describes a driving roller that drives and rotates the fixing belt 51 and the pressing belt 52.

FIG. 3 is a vertical sectional view of a fixing device 5S including a driving roller that drives the fixing belt 51. As illustrated in FIG. 3, a fixing belt driving roller 57 that drives the fixing belt 51 is disposed inside the loop formed by the fixing belt 51. A biasing member (e.g., a spring) attached to the fixing belt driving roller 57 presses the fixing belt driving roller 57 against the inner circumferential surface of the fixing belt 51 so that the fixing belt 51 is stretched over the fixing belt driving roller 57 and the fixing pad 54. As a driver 60 (e.g., a motor) connected to the fixing belt driving roller 57 rotates the fixing belt driving roller 57 in a rotation direction R5, the fixing belt driving roller 57 rotates the fixing belt 51 in a rotation direction R6 by friction generated between an outer circumferential surface of the fixing belt driving roller 57 and the inner circumferential surface of the fixing belt 51. The rotating fixing belt 51 in turn rotates the pressing belt 52 that contacts the fixing belt 51 at the fixing nip N in the rotation direction R4. As a recording medium S bearing an unfixed toner image T enters the fixing nip N, the fixing belt 51 rotating in the rotation direction R6 and the pressing belt 52 rotating in the rotation direction R4 convey the recording medium S in a direction D1. As shown in FIG. 3, the pressing belt 52 has a loop diameter merely great enough to accommodate the pressing pad 56 inside the loop. That is, the pressing belt 52 has a relatively small loop diameter that attains a decreased heat capacity of the pressing belt 52, thus reducing power consumption, shortening the warm-up time and first print time, and downsizing the fixing device 5S.

The fixing belt driving roller 57 may be a metal tube inside which the heater 53 is disposed. Thus, the heater 53 heats the fixing belt driving roller 57 which in turn heats the fixing belt 51. The fixing belt driving roller 57 exerts a force that tensions the fixing belt 51 but is not applied with pressure as great as pressure applied to the fixing pad 54 and the pressing pad 56 at the fixing nip N. Accordingly, the fixing belt driving roller 57 may be a thin metal tube having a decreased heat capacity, reducing power consumption, shortening the warm-up time and first print time, and downsizing the fixing device 5S.

A description is now given of transmission of a driving force generated by the driver 60 from the fixing belt driving roller 57 to the fixing belt 51.

As shown in FIG. 3, the driver 60 is connected to the fixing belt driving roller 57 via a gear train. As the driver 60 generates a driving force, the driving force is transmitted to the fixing belt driving roller 57 through the gear train, thus rotating the fixing belt driving roller 57 in the rotation direction R5. As the fixing belt driving roller 57 rotates, it rotates the fixing belt 51 by friction between the outer circumferential surface of the fixing belt driving roller 57 and the inner circumferential surface of the fixing belt 51. However, it may happen that the fixing belt driving roller 57 transmits the driving force from the driver 60 to the fixing belt 51 insufficiently only by the friction between the fixing belt driving roller 57 and the fixing belt 51. For example, the inner circumferential surface of the fixing belt 51 may slip over the outer circumferential surface of the fixing belt driving roller 57, disturbing rotation of the fixing belt 51 at a predetermined speed. To address this problem, the fixing device 5S has the following configuration that transmits the driving force from the fixing belt driving roller 57 to the fixing belt 51 precisely as shown in FIGS. 4A, 4B, and 4C.

Figure 4A:
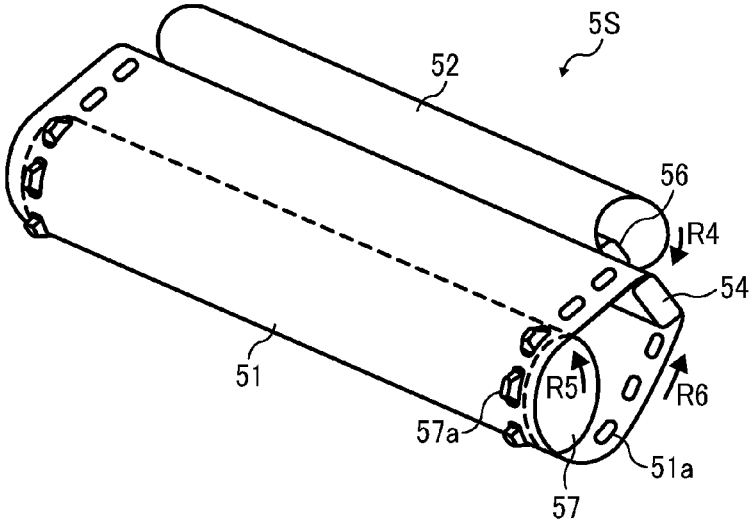
FIG. 4A is a perspective view of the fixing device shown in FIG. 3 illustrating a fixing belt and a fixing belt driving roller.
Figure 4B:
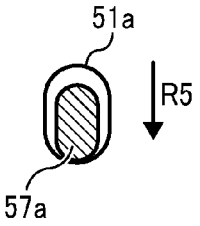
FIG. 4B is a top view of a through-hole produced through the fixing belt shown in FIG. 4A and a protrusion mounted on the fixing belt driving roller shown in FIG. 4A.
Figure 4C:
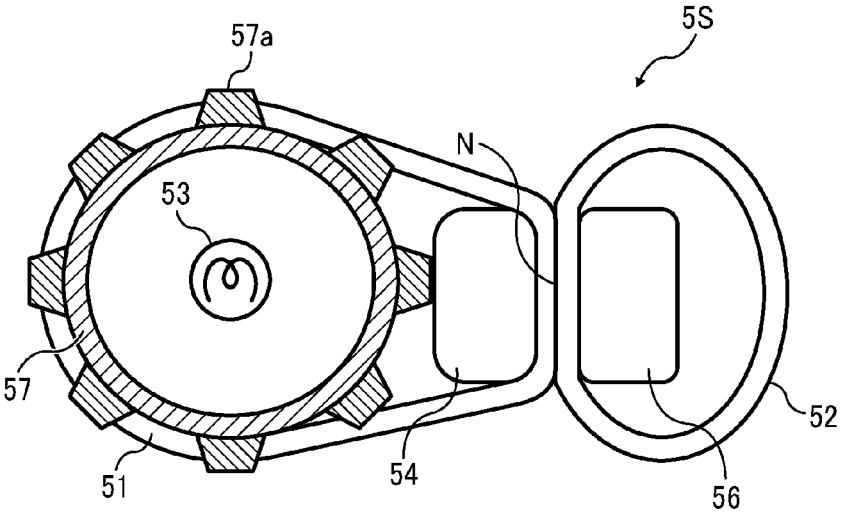
FIG. 4C is a vertical sectional view of the fixing device shown in FIG. 4A.

FIG. 4A is a perspective view of the fixing device 5S. FIG. 4B is a top view of a through-hole 51*a* produced through the fixing belt 51 and a protrusion 57*a* mounted on the fixing belt driving roller 57. FIG. 4C is a vertical sectional view of the fixing device 5S. As illustrated in FIG. 4A, a plurality of protrusions 57*a* is mounted on the outer circumferential surface of the fixing belt driving roller 57 at both lateral ends of the fixing belt driving roller 57 in an axial direction thereof outboard of a recording medium conveyance region through which the recording medium S is conveyed on the fixing belt 51. The plurality of protrusions 57*a* is evenly spaced in a circumferential direction, that is, the rotation direction R5, of the fixing belt driving roller 57 at an equally spaced interval between the adjacent protrusions 57*a*.

On the other hand, a plurality of through-holes 51*a* is produced through both lateral ends of the fixing belt 51 in an axial direction thereof outboard of the recording medium conveyance region through which the recording medium S is conveyed. The plurality of through-holes 51*a* is evenly spaced in a circumferential direction, that is, the rotation direction R6, of the fixing belt 51 at an equally spaced interval between the adjacent through-holes 51*a* similar to the interval between the adjacent protrusions 57*a* of the fixing belt driving roller 57. Thus, the plurality of protrusions 57*a* mounted on the fixing belt driving roller 57 corresponds to the plurality of through-holes 51*a* produced through the fixing belt 51.

As the fixing belt driving roller 57 rotates in the rotation direction R5 and the fixing belt 51 rotates in the rotation direction R6, the protrusions 57*a* of the fixing belt driving roller 57 engage the through-holes 51*a* of the fixing belt 51 like a gear. Accordingly, the fixing belt 51 does not slip over the fixing belt driving roller 57, facilitating transmission of the driving force from the fixing belt driving roller 57 to the fixing belt 51.

Referring to FIG. 4B, a description is now given of the shape of the through-hole 51*a*.

As shown in FIG. 4B, the through-hole 51*a* has four round corners or is circular to prevent local stresses. If the fixing belt 51 is subject to a substantial load, the fixing belt 51 needs to have a greater strength. To attain the greater strength, it is preferable that the base layer of the fixing belt 51 is made of metal rather than resin as shown in FIG. 5.

Figure 5:
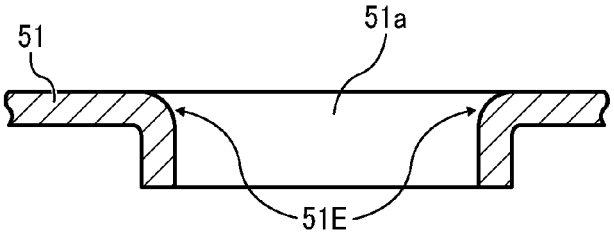
FIG. 5 is a partial vertical sectional view of the fixing belt shown in FIG. 4A.

FIG. 5 is a partial vertical sectional view of the fixing belt 51 made of metal. As shown in FIG. 5, the through-hole 51*a* of the fixing belt 51 has a curved circumferential edge 51E manufactured by drawing a plate to receive stress exerted by the protrusion 57*a* of the fixing belt driving roller 57 in an area increased by the curved circumferential edge 51E, thus decreasing stress per unit area. As a result, the fixing belt 51 attains the greater strength that endures the substantial load imposed by the fixing belt driving roller 57.

Figure 6:
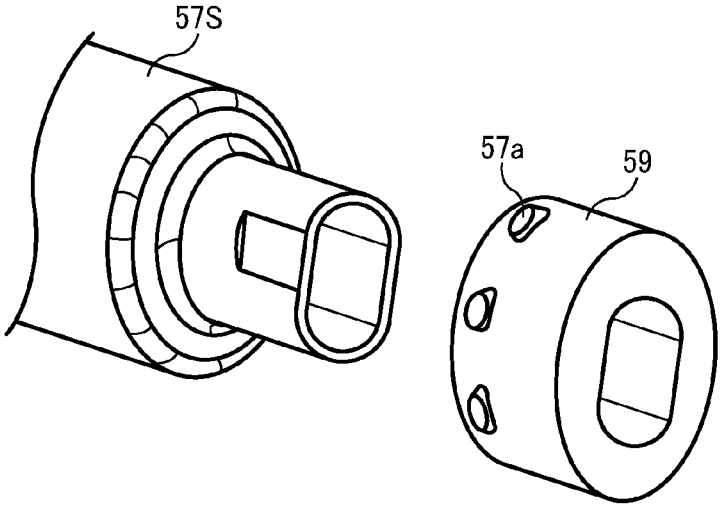
FIG. 6 is a perspective view of a fixing belt driving roller and a driving force transmitter installable in the fixing device shown in FIG. 3.

As shown in FIG. 4C, the protrusions 57*a* are manufactured by bending the fixing belt driving roller 57. Alternatively, the protrusions 57*a* may be mounted on a tubular driving force transmitter 59 (e.g., a flange) separately provided from a fixing belt driving roller 57S as shown in FIG. 6. FIG. 6 is a perspective view of the fixing belt driving roller 57S and the driving force transmitter 59. As shown in FIG. 6, the protrusions 57*a* are evenly spaced on an outer circumferential surface of the driving force transmitter 59 in a circumferential direction thereof at an equally spaced interval between the adjacent protrusions 57*a*. The driving force transmitter 59 engages one lateral end of the fixing belt driving roller 57S in an axial direction thereof. Although not shown, another driving force transmitter 59 engages another lateral end of the fixing belt driving roller 57S in the axial direction thereof.

Figure 7:
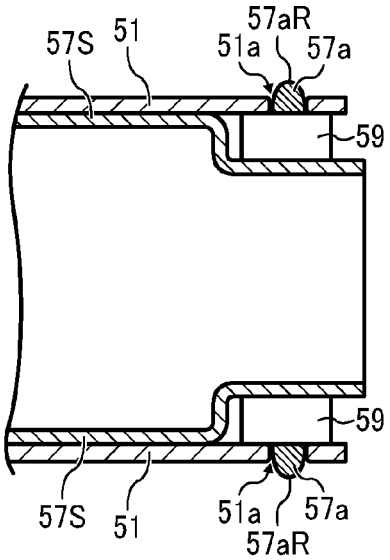
FIG. 7 is a vertical sectional view of the driving force transmitter shown in FIG. 6.

The driving force transmitter 59 detachably attached to the fixing belt driving roller 57S allows greater flexibility in designing the shape of the protrusion 57*a*. For example, the protrusion 57*a* may have a round head 57*a*R that engages the through-hole 51*a* of the fixing belt 51 as shown in FIG. 7. FIG. 7 is a partial vertical sectional view of the driving force transmitter 59 attached to the fixing belt driving roller 57S. The protrusion 57*a* with the round head 57*a*R minimizes local stresses exerted to the fixing belt 51, facilitating improvement in the strength and heat capacity of the fixing belt 51. Alternatively, the protrusion 57*a* may have a shape corresponding to the curved circumferential edge 51E of the through-hole 51*a* of the fixing belt 51 as shown in FIG. 8.

Figure 8:
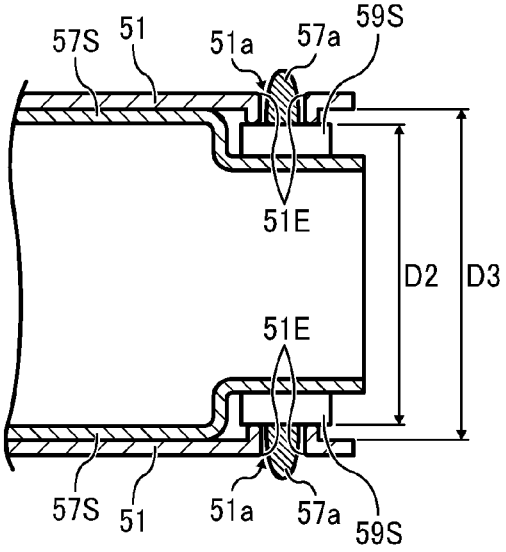
FIG. 8 is a vertical sectional view of a tubular driving force transmitter having a smaller outer diameter installable in the fixing device shown in FIG. 3.

FIG. 8 is a partial vertical sectional view of the protrusions 57*a* mounted on a tubular driving force transmitter 59S having a smaller outer diameter. As shown in FIG. 8, an outer diameter D2 of the driving force transmitter 59S is smaller than an outer diameter D3 of the fixing belt driving roller 57S. The protrusions 57*a* are mounted on an outer circumferential surface of the driving force transmitter 59S. For example, the driving force transmitter 59S does not contact the curved circumferential edge 51E of the through-hole 51*a* of the fixing belt 51. That is, the fixing belt 51 contacts the protrusions 57*a* mounted on the driving force transmitter 59S and is isolated from the driving force transmitter 59S, minimizing heat drawn from the fixing belt 51 to the driving force transmitter 59S. Thus, the driving force transmitter 59S having the outer diameter D2 smaller than the outer diameter D3 of the fixing belt driving roller 57S reduces an area in which the driving force transmitter 59S contacts the fixing belt 51, improving heat insulation.

Figure 9:
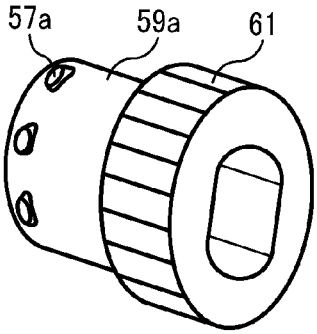
FIG. 9 is a perspective view of a tubular driving force transmitter installable in the fixing device shown in FIG. 3 and a gear combined with the tubular driving force transmitter.

Alternatively, the driving force transmitter 59 may be combined with a gear 61 as shown in FIG. 9. FIG. 9 is a perspective view of a tubular driving force transmitter 59*a* combined with the gear 61. As shown in FIG. 9, the driving force transmitter 59*a* is combined with the gear 61 that transmits a driving force generated by the driver 60 depicted in FIG. 3 to the driving force transmitter 59*a*, reducing the number of parts constituting the fixing device 5S and therefore reducing manufacturing costs.

Figure 10:
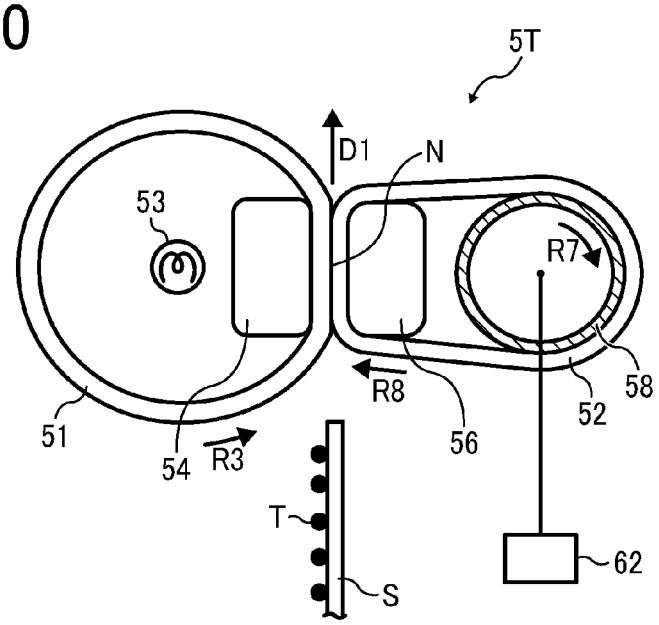
FIG. 10 is a vertical sectional view of a fixing device according to yet another example embodiment.

The configuration of the components described above with reference to FIGS. 2 to 9 incorporated inside the loop formed by the fixing belt 51 is also applicable to the pressing belt 52 as shown in FIG. 10.

FIG. 10 is a vertical sectional view of a fixing device 5T installed with a pressing belt driving roller 58 that rotates the pressing belt 52. As illustrated in FIG. 10, the pressing belt driving roller 58 is disposed inside the loop formed by the pressing belt 52. A biasing member (e.g., a spring) presses the pressing belt driving roller 58 against an inner circumferential surface of the pressing belt 52 to tension the pressing belt 52. A driver 62 (e.g. a motor) is connected to the pressing belt driving roller 58 to drive and rotate the pressing belt driving roller 58. As the pressing belt driving roller 58 rotates in a rotation direction R7, friction between an outer circumferential surface of the pressing belt driving roller 58 and the inner circumferential surface of the pressing belt 52 rotates the pressing belt 52 in a rotation direction R8. The rotating pressing belt 52 in turn rotates the fixing belt 51 that contacts the pressing belt 52 at the fixing nip N. As a recording medium S bearing an unfixed toner image T enters the fixing nip N, the fixing belt 51 rotating in the rotation direction R3 and the pressing belt 52 rotating in the rotation direction R8 convey the recording medium S in the direction D1. Preferably, the pressing belt driving roller 58 has a minimized heat capacity while attaining a capability of rotating the pressing belt 52, thus decreasing the heat capacity of the fixing device 5T.

As shown in FIG. 10, the pressing belt driving roller 58 is disposed inside the loop formed by the pressing belt 52 and the driver 62 is connected to the pressing belt driving roller 58 like the fixing belt driving roller 57 disposed inside the fixing belt 51 as shown in FIG. 3. However, unlike the fixing belt 51 shown in FIG. 3, even though the pressing belt driving roller 58 is disposed inside the pressing belt 52, no heater is disposed inside the pressing belt driving roller 58. Accordingly, the heat capacity of the pressing belt driving roller 58 affects the heat capacity of the entire fixing device 5T less compared to the heat capacity of the fixing belt driving roller 57 of the fixing device 5S depicted in FIG. 3. That is, the pressing belt driving roller 58 can have a heat capacity greater than that of the fixing belt driving roller 57.

Figure 11A:
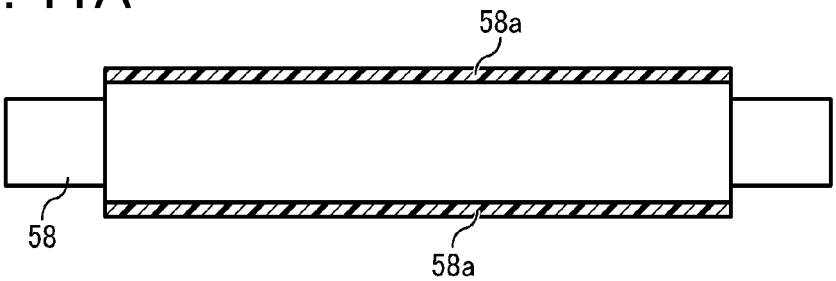
FIG. 11A is a horizontal sectional view of a pressing belt driving roller installable in the fixing device shown in FIG. 10 having a frictional surface layer extending throughout substantially the entire width of the pressing belt driving roller.

To address this circumstance, a surface layer 58*a* made of a frictional material constitutes an outer surface layer of the pressing belt driving roller 58, thus facilitating transmission of a driving force generated by the driver 62 from the pressing belt driving roller 58 to the pressing belt 52 as shown in FIG. 11A. FIG. 11A is a horizontal sectional view of the pressing belt driving roller 58 having the surface layer 58*a*. For example, the surface layer 58*a* is a thin, heat-resistant silicone rubber layer having a thickness in a range of from about 0.2 mm to about 0.5 mm, which facilitates transmission of the driving force from the pressing belt driving roller 58 to the pressing belt 52. With this configuration, it is not necessary to perform extra processing on the pressing belt 52, for example, producing the through-holes 51*a* depicted in FIG. 4A in the pressing belt 52.

Figure 11B:
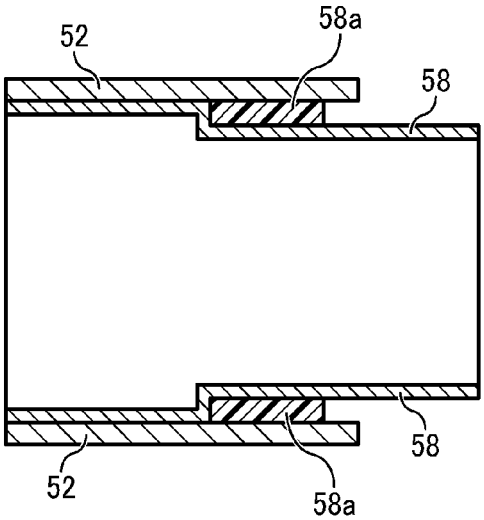
FIG. 11B is a partial horizontal sectional view of a pressing belt driving roller installable in the fixing device shown in FIG. 10 having a frictional surface layer at both lateral ends of the pressing belt driving roller in an axial direction thereof.

The surface layer 58*a* extends throughout substantially the entire width of pressing belt driving roller 58 as shown in FIG. 11A. Alternatively, the surface layer 58*a* may be disposed at a part of the pressing belt driving roller 58 as shown in FIG. 11B. FIG. 11B is a partial horizontal sectional view of the pressing belt driving roller 58 and the pressing belt 52. As shown in FIG. 11B, the surface layer 58*a* is disposed on one lateral end of the pressing belt driving roller 58 in an axial direction thereof, that is, in a non-conveyance region through which the recording medium S is not conveyed on the pressing belt 52, thus minimizing the heat capacity of the pressing belt driving roller 58. Although not shown, the surface layer 58*a* is also disposed on another lateral end of the pressing belt driving roller 58 in the axial direction thereof. The frictional surface layer 58*a* shown in FIGS. 11A and 11B is also applicable to the fixing belt driving roller 57 depicted in FIG. 3 to minimize the heat capacity of the fixing belt driving roller 57.

As illustrated in FIG. 10, the heater 53 is disposed inside the loop formed by the fixing belt 51 to heat the fixing belt 51 directly. That is, the heater 53 heats the fixing belt 51 effectively with no intermedium interposed therebetween, reducing power consumption and shortening the warm-up time and first print time. The heater 53 may be a halogen heater that is installed in the fixing device 5T at decreased manufacturing costs. However, the configuration in which the heater 53 heats the fixing belt 51 directly may not control the temperature of the fixing belt 51 precisely if the heat capacity of the fixing belt 51 is too small. For example, the temperature of the fixing belt 51 fluctuates from a target fixing temperature, generating substantial temperature ripple. Consequently, a faulty toner image is formed on the recording medium S due to hot offset or cold offset of toner.

Figure 12:
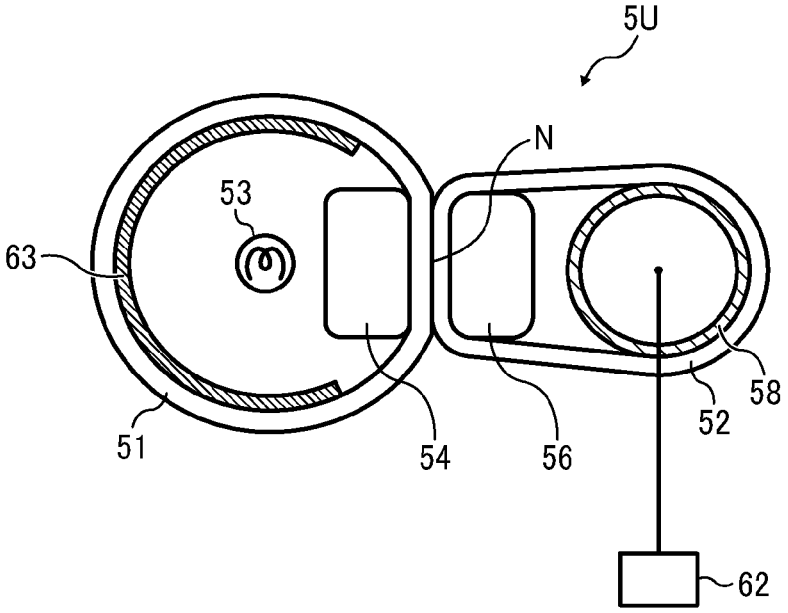
FIG. 12 is a vertical sectional view of a fixing device according to yet another example embodiment.

To address this problem, a sleeve 63 may be interposed between the fixing belt 51 and the heater 53 as shown in FIG. 12 to stabilize the temperature of the fixing belt 51. FIG. 12 is a vertical sectional view of a fixing device 5U installed with the sleeve 63, For example, the sleeve 63 made of metal is disposed opposite the inner circumferential surface of the fixing belt 51. The sleeve 63 that increases the heat capacity and the thermal storage of the fixing device 5U reduces fluctuation of the temperature of the fixing belt 51 and facilitates control of the temperature of the fixing belt 51 compared to the configuration in which the heater 53 heats the fixing belt 51 directly. However, if the heat capacity of the sleeve 63 is too great, the sleeve 63 increases power consumption and lengthens the warm-up time and first print time, thus deteriorating energy saving efficiency. Accordingly, the sleeve 63 is required to have an appropriate heat capacity that attains both stabilization of the temperature of the fixing belt 51 and a decreased heat capacity of the fixing device 5U.

Like the sleeve 63, the fixing belt driving roller 57 depicted in FIG. 3 inside which the heater 53 is disposed can reduce fluctuation of the temperature of the fixing belt 51. In this case, however, the fixing belt driving roller 57 serves as an intermedium that conducts heat generated by the heater 53 to the fixing belt 51, not as a driver that drives and rotates the fixing belt 51.

Figure 13:
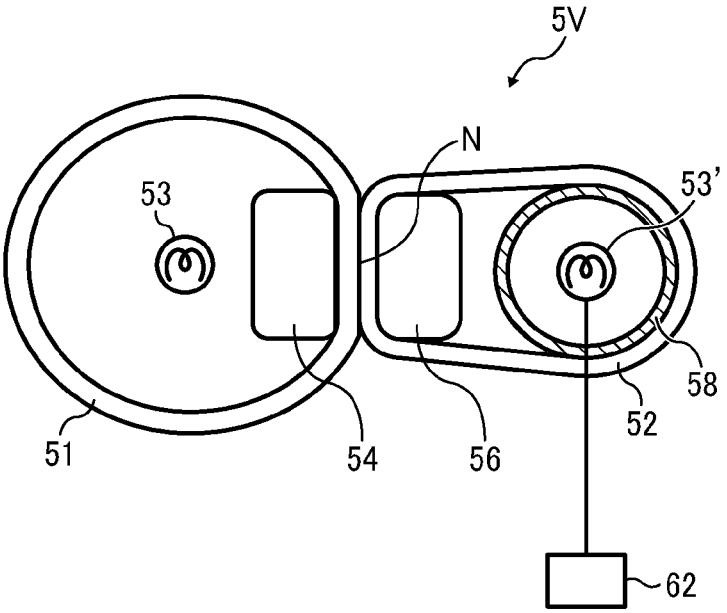
FIG. 13 is a vertical sectional view of a fixing device according to yet another example embodiment.

As a variation of the fixing device ST depicted in FIG. 10, another heater 53' may be disposed inside the pressing belt driving roller 58 as shown in FIG. 13. FIG. 13 is a vertical sectional view of a fixing device 5V installed with the heater 53' in addition to the heater 53 disposed inside the fixing belt 51. The two heaters 53 and 53' heat both sides of a recording medium as it is conveyed through the fixing nip N, shortening the warm-up time of the fixing device 5V. Although the two heaters 53 and 53' save less energy compared to the single heater 53 of the fixing device 5T depicted in FIG. 10, the two heaters 53 and 53' shorten the warm-up time more than the single heater 53.

Referring to FIGS. 2 to 13, the following describes advantages of the fixing devices 5, 5S, 5T, 5U, and 5V according to the example embodiments described above.

The fixing devices 5, 5S, 5T, 5U, and 5V include the fixing belt 51 facing the image side of a recording medium S that bears an unfixed toner image T and the pressing belt 52 facing the non-image side of the recording medium S that does not bear the unfixed toner image T. The stationary fixing pad 54 disposed inside the loop formed by the fixing belt 51 presses against the stationary pressing pad 56 disposed inside the loop formed by the pressing belt 52, forming the fixing nip N between the fixing pad 54 and the pressing pad 56 with the fixing belt 51 and the pressing belt 52 interposed between the fixing pad 54 and the pressing pad 56. As the recording medium S is conveyed through the fixing nip N, the fixing belt 51 and the pressing belt 52 apply heat and pressure to the recording medium 5, thus melting and fixing the unfixed toner image T on the recording medium S. As shown in FIG. 3, the fixing belt driving roller 57 disposed inside the loop formed by the fixing belt 51 separately from the fixing pad 54 and connected to the driver 60 drives and rotates the fixing belt 51. Alternatively, as shown in FIG. 10, the pressing belt driving roller 58 disposed inside the loop formed by the pressing belt 52 separately from the pressing pad 56 and connected to the driver 62 drives and rotates the pressing belt 52.

As shown in FIG. 4A, the through-holes 51*a* are produced through the fixing belt 51 and the protrusions 57*a* are mounted on the fixing belt driving roller 57. As a driving force generated by the driver 60 rotates the fixing belt driving roller 57 as shown in FIG. 3, the protrusions 57*a* of the fixing belt driving roller 57 engage the through-holes 51*a* of the fixing belt 51. Alternatively, the through-holes 51*a* may be produced through the pressing belt 52 depicted in FIG. 10 and the protrusions 57*a* may be mounted on the pressing belt driving roller 58 depicted in FIG. 10. In this case, as a driving force generated by the driver 62 rotates the pressing belt driving roller 58, the protrusions 57*a* of the pressing belt driving roller 58 engage the through-holes 51*a* of the pressing belt 52.

As shown in FIG. 5, the through-hole 51*a* has the curved circumferential edge 51E manufactured by drawing a plate.

As shown in FIG. 4A, the protrusions 57*a* mounted on both lateral ends of the fixing belt driving roller 57 in the axial direction thereof engage the through-holes 51*a* of the fixing belt 51 to transmit a driving force from the driver 60 depicted in FIG. 3 to the fixing belt 51. Alternatively, the protrusions 57*a* may be mounted on both lateral ends of the pressing belt driving roller 58 depicted in FIG. 10 in the axial direction thereof and the through-holes 51*a* may be produced through the pressing belt 52 depicted in FIG. 10. Thus, the protrusions 57*a* of the fixing belt driving roller 57 or the pressing belt driving roller 58 engage the through-holes 51*a* of the fixing belt 51 or the pressing belt 52 to transmit a driving force from the driver 60 or 62 to the fixing belt 51 or the pressing belt 52.

As shown in FIG. 6, the protrusions 57*a* may be mounted on the driving force transmitter 59 detachably attached to the fixing belt driving roller 57S. Alternatively, the protrusions 57*a* may be mounted on the driving force transmitter 59 detachably attached to the pressing belt driving roller 58 depicted in FIG. 10.

As shown in FIG. 11A, the frictional surface layer 58*a* having a small heat capacity may constitute the outer circumferential surface of the pressing belt driving roller 58 that transmits a driving force from the driver 62 to the pressing belt 52 depicted in FIG. 10. Alternatively, the frictional surface layer 58*a* may constitute the outer circumferential surface of the fixing belt driving roller 57 that transmits a driving force from the driver 60 to the fixing belt 51 depicted in FIG. 3.

As shown in FIG. 11B, the frictional surface layer 58*a* may be disposed on both lateral ends of the outer circumferential surface of the pressing belt driving roller 58 in the axial direction thereof, that is, in the non-conveyance regions through which the recording medium S is not conveyed on the pressing belt 52, thus transmitting a driving force from the driver 62 depicted in FIG. 10 to the pressing belt 52. Alternatively, the frictional surface layer 58*a* may be disposed on both lateral ends of the outer circumferential surface of the fixing belt driving roller 57 in the axial direction thereof, that is, in the non-conveyance regions through which the recording medium S is not conveyed on the fixing belt 51, thus transmitting a driving force from the driver 60 to the fixing belt 51 as shown in FIG. 3.

With the above-described configurations of the fixing devices 5S and 5T, a driving force generated by the driver 60 or 62 is transmitted to the fixing belt 51 or the pressing belt 52 precisely with a minimized heat capacity of the components incorporated in the fixing devices 5S and 5T at reduced manufacturing costs, thus reducing power consumption, shortening the warm-up time and first print time, and downsizing the fixing devices 5S and 5T.

As shown in FIGS. 3 and 10, the fixing pad 54 disposed inside the fixing belt 51 presses against the pressing pad 56 disposed inside the pressing belt 52 to form the fixing nip N between the fixing belt 51 and the pressing belt 52 through which the recording medium S bearing the unfixed toner image T is conveyed.

For example, as shown in FIG. 3, the fixing belt driving roller 57 connected to the driver 60 is disposed inside the fixing belt 51 to transmit a driving force generated by the driver 60 to the fixing belt 51, thus rotating the fixing belt 51. The rotating fixing belt 51 in turn rotates the pressing belt 52 by friction therebetween. The heater 53 disposed inside the fixing belt driving roller 57 heats the fixing belt driving roller 57 which in turn heats the fixing belt 51. With this configuration, as the recording medium S is conveyed through the fixing nip N, the fixing belt 51 and the pressing belt 52 apply heat and pressure to the recording medium S, thus melting and fixing the toner image T on the recording medium S. Alternatively, as shown in FIGS. 10, 12, and 13, the pressing belt driving roller 58 connected to the driver 62 is disposed inside the pressing belt 52 to transmit a driving force generated by the driver 62 to the pressing belt 52, thus rotating the pressing belt 52. The rotating pressing belt 52 in turn rotates the fixing belt 51 by friction therebetween.

As shown in FIGS. 10 and 13, the heater 53 disposed inside the fixing belt 51 may be a halogen heater that heats the fixing belt 51 directly, minimizing the heat capacity of the components incorporated in the fixing devices 5T and 5V and thus reducing power consumption, shortening the warm-up time and first print time, and downsizing the fixing devices 5T and 5V. Accordingly, the heater 53 heats the fixing belt 51 effectively. As shown in FIG. 12, the sleeve 63 may be disposed opposite the inner circumferential surface of the fixing belt 51 in such a manner that the sleeve 63 is interposed between the heater 53 and the fixing belt 51. Thus, the sleeve 63 conducts heat from the heater 53 to the fixing belt 51 with reduced fluctuation of the temperature of the fixing belt 51. As shown in FIG. 13, another heater 53' may be disposed inside the pressing belt driving roller 58 to heat the pressing belt 52, further shortening the warm-up time and first print time.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing belt formed into a loop and rotatable in a predetermined direction of rotation;

a pressing belt formed into a loop to frictionally contact the fixing belt and rotatable in a direction counter to the direction of rotation of the fixing belt;

a stationary fixing pad that contacts an inside surface of the loop formed by the fixing belt;

a stationary pressing pad disposed inside the loop formed by the pressing belt;

a roller disposed inside only one of the loop formed the fixing belt and the loop formed by the pressing belt and contacting an inner circumferential surface of the one of the fixing belt and the pressing belt;

a driver connected to the roller, wherein the roller transmits a driving force generated by the driver to the one of the fixing belt and the pressing belt;

a fixing belt heater disposed inside the loop formed by the fixing belt, at a non-contacting distance from the fixing pad, to heat the fixing belt, the fixing pad pressing against the pressing pad to form a fixing nip therebetween with the fixing belt and the pressing belt interposed between the fixing pad and the pressing pad, the fixing nip through which a recording medium bearing an unfixed toner image is conveyed in a state in which the unfixed toner image contacts the fixing belt;

a through-hole produced through the one of the fixing belt and the pressing belt;

a pair of tubular driving force transmitters detachably attached to both lateral ends of the roller in an axial direction thereof; and a protrusion mounted on an outer circumferential surface of the pair of tubular driving force transmitters to engage the through-hole of the one of the fixing belt and the pressing belt, wherein an outer diameter of the pair of tubular driving force transmitters is smaller than an outer diameter of the roller.

2. The fixing device according to claim 1, further comprising:

a through-hole produced through the one of the fixing belt and the pressing belt; and a protrusion mounted on an outer circumferential surface of the driving roller to engage the through-hole of the one of the fixing belt and the pressing belt.

3. The fixing device according to claim 2, wherein the through-hole includes a curved circumferential edge.

4. The fixing device according to claim 2, wherein the protrusion is mounted on both lateral ends of the roller in an axial direction thereof.

5. The fixing device according to claim 1, wherein the protrusion has a round head that engages the through-hole of the one of the fixing belt and the pressing belt.

6. The fixing device according to claim 1, further comprising a gear connected to the driver and combined with the pair of tubular driving force transmitters.

7. The fixing device according to claim 1, wherein the roller includes a frictional surface layer that contacts the inner circumferential surface of the one of the fixing belt and the pressing belt.

8. The fixing device according to claim 7, wherein the frictional surface layer is disposed on both lateral ends of the roller in an axial direction thereof corresponding to non-conveyance regions on the fixing belt and the pressing belt through which the recording medium is not conveyed.

9. The fixing device according to claim 1, wherein the fixing belt heater includes a halogen heater.

10. The fixing device according to claim 1, further comprising a sleeve disposed inside the loop formed by the fixing belt and interposed between the fixing belt heater and the fixing belt, the sleeve conducting heat from the fixing belt heater to the fixing belt.

11. The fixing device according to claim 1, further comprising a pressing belt heater disposed inside the loop formed by the pressing belt to heat the pressing belt.

12. An image forming apparatus comprising the fixing device according to claim 1.

13. The fixing device according to claim 1, wherein the fixing belt heater is disposed inside the loop formed by the fixing belt without an intermedium interposed between the heater and the fixing belt.

14. The fixing device according to claim 1, wherein the fixing belt heater is configured to heat the fixing belt directly.

15. The fixing device according to claim 1, wherein one of the fixing pad and the pressing pad is between the roller and the fixing belt.

* * * * *